US009562547B2

(12) United States Patent
Staab et al.

(10) Patent No.: US 9,562,547 B2
(45) Date of Patent: Feb. 7, 2017

(54) ELECTRIC HYDRAULIC ACTUATOR

(71) Applicant: ABB Technology AG, Zurich (CH)

(72) Inventors: Harald Staab, Bavaria (DE); Jeremy Newkirk, West Hartford, CT (US); Thomas Fuhlbrigge, Ellington, CT (US)

(73) Assignee: ABB Schweiz AG, Braden (CH)

( * ) Notice: Subject to any disclaimer, the term of this patent is extended or adjusted under 35 U.S.C. 154(b) by 334 days.

(21) Appl. No.: 14/473,396

(22) Filed: Aug. 29, 2014

(65) Prior Publication Data

US 2016/0061233 A1 Mar. 3, 2016

(51) Int. Cl.

| | |
|---|---|
| ***F15B 15/14*** | (2006.01) |
| ***F15B 15/18*** | (2006.01) |
| *F15B 1/26* | (2006.01) |

(52) U.S. Cl.

CPC ..... *F15B 15/1447* (2013.01); *F15B 15/18* (2013.01); *F15B 1/265* (2013.01); *F15B 15/1457* (2013.01); *F15B 2201/00* (2013.01); *F15B 2211/7054* (2013.01); *F15B 2211/785* (2013.01)

(58) Field of Classification Search

CPC ..... F15B 1/265; F15B 2211/02561; F15B 2211/7053

USPC ..... 60/473, 475, 476

See application file for complete search history.

(56) References Cited

U.S. PATENT DOCUMENTS

| | | | |
|---|---|---|---|
| 8,303,670 | B2 | 11/2012 | Martin et al. |
| 8,360,997 | B2 | 1/2013 | Ferrara |
| 2012/0055149 | A1 | 3/2012 | Vonderwell |
| 2012/0067035 | A1 | 3/2012 | Sweeney et al. |
| 2012/0291873 | A1 | 11/2012 | Potter et al. |

FOREIGN PATENT DOCUMENTS

| | | | |
|---|---|---|---|
| CN | 102588382 | A | 7/2012 |
| DE | 102 57 414 | A1 | 6/2004 |
| DE | 20 2007 013 300 | U1 | 3/2009 |
| EP | 0 314 014 | A1 | 3/1989 |
| EP | 0 580 319 | A1 | 1/1994 |
| EP | 2 149 434 | A1 | 3/2010 |
| JP | 2005/127344 | A | 5/2005 |

(Continued)

OTHER PUBLICATIONS

Parker Hannifin Corp., "Compact EHA, Electro-Hydraulic Actuators for High Power Density Applications" *Parker Hannifin—Oildyne Division*, (Mar. 2011), pp. 1-8.

(Continued)

*Primary Examiner* — Thomas E Lazo

(74) *Attorney, Agent, or Firm* — Taft Stettinius & Hollister LLP

(57) ABSTRACT

There is set forth herein an actuator having a housing and a piston assembly. The piston assembly can have a piston and a piston rod extending from the piston. In one embodiment, the housing can receive the piston and a portion of the piston rod. The piston assembly can define a piston assembly interior and a fluid reservoir can be located within the piston assembly interior. A chamber region within the interior of the housing can be separated by the piston assembly to define a piston side chamber and rod side chamber. The piston assembly can be moveable so that respective volumes of each of the piston side chamber and the rod side chamber are variable. For operation of the actuator by movement of the piston assembly within the interior of the housing, fluid can be moved between the reservoir and the chamber region.

15 Claims, 9 Drawing Sheets

(56) References Cited

FOREIGN PATENT DOCUMENTS

| | | | |
|---|---|---|---|
| WO | WO 01/90490 | A1 | 11/2001 |
| WO | WO 2008/143073 | A1 | 11/2008 |
| WO | WO 2010/011848 | A1 | 1/2010 |
| WO | WO 2012/124853 | A1 | 9/2012 |
| WO | WO 2013/054954 | A1 | 4/2013 |

OTHER PUBLICATIONS

Micromatic, LLC., "Hydraulic Rotary Actuators", *Micromatic LLC*., (May 2007 / REV. Jun. 2007), pp. 1-7, E-1-E-19, MP-1-MP-4, SS-1-SS-4, HS-1-HS4, R-1-R-4, and OA-1-OA-6, vol. 9.

Kleegrewe, Thomas, Schulze, Stephan and Horst, Bender, "ABB Actuator & Positioners—Valve and damper controls in power plants", *ABB Instrumentation*, (2010), pp. 1-4.

Wikipedia, "Electro-hydrostatic actuator", *wikipedia.org*, Apr. 30, 2014.

Frischemeier, Stefan, "Electrohydrostatic Actuators for Aircraft Primary Flight Control—Types, Modelling and Evaluation", *5th Scandinavian International Conference on Fluid Power*, (May 28-30 Jan. 1997 ) pp. 1-16.

Navarro, Robert, "Performance of an Electro-Hydrostatic Actuator on the F-18 Systems Research Aircraft", *NASA/TM-97-206224 Dryden Flight Research Center*, (Oct. 1997), pp. 1-32.

Micromatic, LLC, "Actuators for Garbage and Trash Trucks", *micromaticllc.com*, (May 8, 2014).

U.S. Appl. No. 14/473,431, filed Aug. 29, 2014.

ELECTRIC HYDRAULIC ACTUATOR

FIELD

There is set forth herein an actuator, and more particularly a hydraulic actuator.

BACKGROUND

Actuators are currently available in multiple varieties including electric ballscrew actuators, electric threaded rod actuators and Electric Hydraulic Actuators (EHAs).

According to one currently available EHA design an EHA includes a hydraulic cylinder unit with a fully encapsulated hydraulic supply system comprising a reservoir, check valves and relief valves, and a hydraulic pump, which is powered by an electric motor. The reservoir includes a volume of compressed gas separating the gas from the hydraulic fluid and allowing for orientation independent operation of the unit. In general, when the electric motor is driven in a first rotational direction, the hydraulic pump moves the fluid into the fluid chamber of the hydraulic actuator and out of the piston chamber, thereby extending a piston rod from the actuator housing. When the electric motor is driven in a second rotational direction, opposite the first rotational direction, the hydraulic pump moves the hydraulic fluid out of the fluid chamber and into the piston chamber, thereby retracting the rod.

BRIEF DESCRIPTION

There is set forth herein an actuator having a housing and a piston assembly. The piston assembly can have a piston and a piston rod extending from the piston. In one embodiment, the housing can receive the piston and a portion of the piston rod. The piston assembly can define a piston assembly interior and a fluid reservoir can be located within the piston assembly interior. A chamber region within the interior of the housing can be separated by the piston assembly to define a piston side chamber and rod side chamber. The piston assembly can be moveable so that respective volumes of each of the piston side chamber and the rod side chamber are variable. For operation of the actuator by movement of the piston assembly within the interior of the housing, fluid can be moved between the reservoir and the chamber region.

BRIEF DESCRIPTION OF THE SEVERAL VIEWS OF THE DRAWINGS

One or more aspects as set forth herein are particularly pointed out and distinctly claimed as examples in the claims at the conclusion of the specification. The foregoing and other objects, features, and advantages of the invention are apparent from the following detailed description taken in conjunction with the accompanying drawings in which:

DETAILED DESCRIPTION

Figure 1:
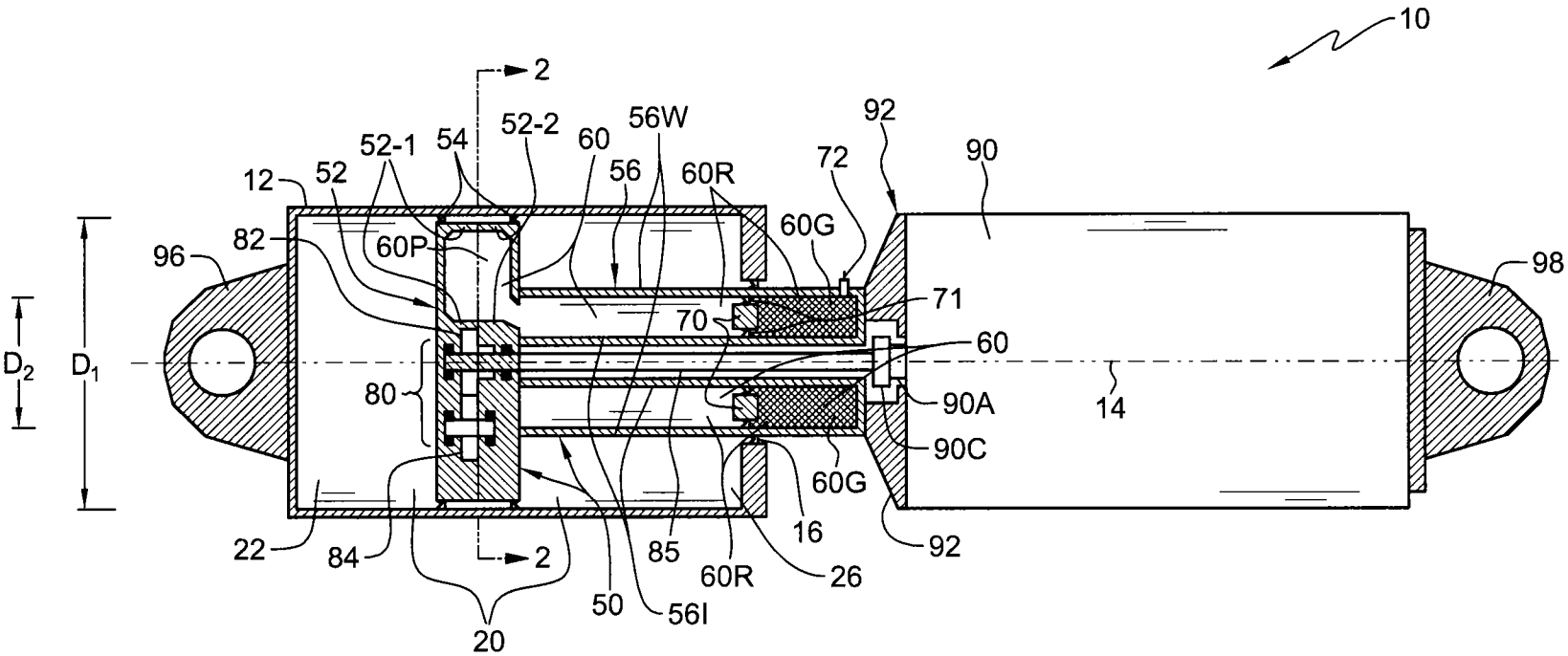
FIG. 1 is a cross sectional view of an actuator.

With reference to the cross sectional view of FIG. 1 there is shown an exemplary actuator 10 having a housing 12 and a piston assembly 50. The piston assembly 50 can have a piston 52 and a piston rod 56 extending from the piston 52. In one embodiment housing 12 can have an interior that receives piston assembly 50 by receiving an entirety of the piston 52 and a portion of the piston rod 56. The piston assembly 50 can define a piston assembly interior and a fluid reservoir 60 can be located within the piston assembly interior. In one embodiment, reservoir 60 can be defined by walls that define piston assembly 50. An interior and exterior of piston assembly 50 in the embodiment of FIG. 1 can be defined by wall 52-1 of piston 52, wall 52-2 of piston 52, and wall 56W of piston rod 56. A chamber region 20 within the interior of the housing 12 can be separated by the piston assembly 50 to define a piston side chamber 22 and rod side chamber 26. Each of piston side chamber 22 and rod side chamber 26 can be further defined by an interior surface of a wall defining housing 12. Piston assembly 50 can be moveable so that respective volumes of each of the piston side chamber 22 and the rod side chamber 26 are variable. Fluid can be pumped by pump 80 between the reservoir 60 located at the interior of the piston assembly 50 and the chamber region 20 to move piston assembly 50 within an interior of housing 12 and to provide actuation. A locating of reservoir 60 within an interior of piston assembly 50 can provide various advantages as are set forth herein.

In one aspect of piston assembly 50, piston 52 can include a diameter D1 and piston rod 56 can include a diameter of $D_2$, where $D_2<D_1$. In another aspect of piston assembly 50, an outer surface of a wall 52-1, 52-2, and 56W defining piston assembly 50 can delimit chamber region 20. As shown in FIG. 1, there can be disposed within an interior of piston assembly 50 a reservoir 60. Reservoir 60 in one embodiment can extend between an interior of the piston 52 defined by wall 52-1 and wall 52-2 and an interior of the rod 56 of the piston assembly 50 defined by wall 56W. Reservoir 60 in one embodiment can include a section 60P located within an interior of piston 52 and a section 60R located within an interior of piston rod 56. In one embodiment, reservoir 60 can be included within an interior of piston assembly 50 by being entirely included within an interior of piston assembly 50. In one embodiment, reservoir 60 can be included within an interior of piston assembly 50 by being partially included within an interior of piston assembly 50.

Figure 2:
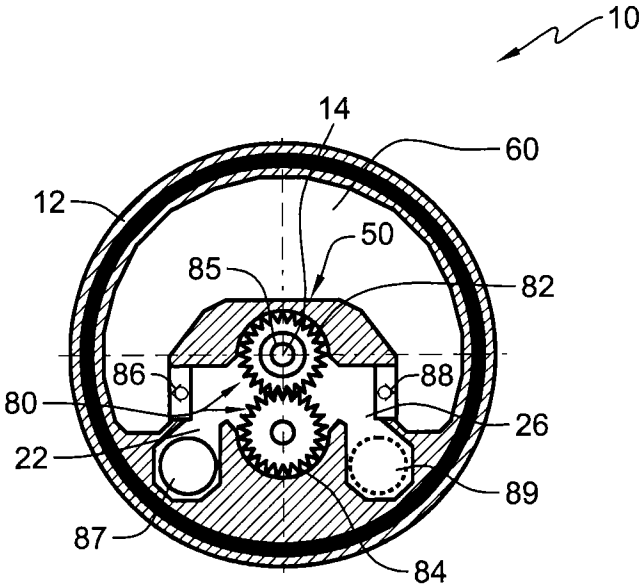
FIG. 2 is a cross sectional view taken along line 2-2 of FIG. 1.

In one embodiment, there can be further disposed within an interior of piston assembly 50 a pump 80. One exemplary embodiment of pump 80 is shown in FIGS. 1 and 2 and is explained in further detail in reference to the cross sectional view of FIG. 2, taken along line 2-2 of FIG. 1. Pump 80 can be operative to move fluid between reservoir 60 and chamber region 20 to move a position of piston assembly 50 within housing 12 to thereby provide actuation.

In one embodiment shown and described with reference to FIGS. 1 and 2, pump 80 can be a gear pump having gears 82 and 84. Gears 82 and 84 can be driven by motor 90 which can be supported by a motor support 92 which can be rigidly joined to a distal end of piston rod 56. Drive gear 82 can be connected to motor 90 by way of pump drive shaft 85 which can be coupled to motor axle 90A by motor coupling 90C so that drive gear 82 rotates when motor 90 rotates. Motor 90 can be an electric motor. Actuator 10 can be configured so that driving drive gear 82 in a first direction causes fluid from rod side chamber 26 and from reservoir 60 to flow into piston side chamber 22. Actuator 10 can be configured so that driving drive gear 82 in a second direction opposite to the first direction causes fluid from piston side chamber 22 and from reservoir 60 to flow into rod side chamber 26. In one aspect wall 56I of piston rod 56 can define an inner cylinder and wall 56W can define an outer cylinder. Reservoir 60 can be partially or entirely located within an annular volume (annulus) defined between wall 56I and wall 56W of piston rod 56. In one embodiment opposing annulus facing surfaces of wall 56I and wall 56W defining piston assembly 50 can define reservoir 60. In the embodiment of FIG. 1, a portion of reservoir 60 located within an interior of piston rod 56 can be on an annular volume. Pump shaft 85 can be disposed in an interior of an inner cylinder defined by wall 56I, which forms part of an interior of piston rod 56.

Actuator 10 can include check valves 86 and 88. Check valve 86 can be disposed between reservoir 60 and piston side chamber 22 which piston side chamber 22 can extend into an interior of piston assembly 50 as shown in FIG. 2. Opening 87 as shown in FIG. 2 can be defined on a wall of piston assembly 50 and can open out into a major volume of piston side chamber 22. Opening 87 can provide fluid communication between a minor volume of piston side chamber 22 within piston assembly 50 and major volume of piston side chamber 22 defined externally to piston assembly 50 and within an interior of housing 12.

Check valve 88 can be disposed between reservoir 60 and rod side chamber 26 which chamber 26 can extend into an interior of piston assembly 50 as shown in FIG. 2. Actuator 10 can include opening 89 defined on a wall of piston assembly 50 that can open out into a major volume of rod side chamber 26. Opening 89 can provide fluid communication between a minor volume of rod side chamber 26 within piston assembly 50 and major volume of rod side chamber 26 defined externally to piston assembly 50 and within an interior of housing 12.

Actuator 10 can be configured so that when gears 82, 84 rotate in a first direction, check valve 86 closes and check valve 88 opens. Drive gear 82 can be driven by motor 90 which can be connected to drive gear 82 via shaft 85 which can be coupled by motor coupling 90C to motor axle 90A. With gears 82, 84 being driven by motor 90 to rotate in a first direction, a pressure (pump) side of pump 80 can be established in piston side chamber 22 and a suction side of pump 80 can be established in rod side chamber 26. With a pressure side of pump 80 established in piston side chamber 22 and a suction side of pump 80 established in rod side chamber 26 fluid from rod side chamber 26 and/or from reservoir 60 can be pumped by pump 80 from the suction side of pump 80 to the pressure side of pump 80 and can be pumped by pump 80 into a major volume of piston side chamber 22 through opening 87. Further, with check valve 88 separating rod side chamber 26 and reservoir 60 open, fluid that is drawn by pump 80 from a major volume of rod side chamber 26 through opening 89 can move into reservoir 60 through check valve 88.

Actuator 10 can be configured so that when gears 82, 84 rotate in a second direction opposite the first direction, check valve 88 can be closed and check valve 86 can be open. With gears 82, 84 driven by motor 90 to rotate in a second direction opposite the first direction, a pressure side of pump 80 can be established in rod side chamber 26 and a suction side of pump 80 can be established in piston side chamber 22. With a pressure side of pump 80 established in rod side chamber 26 and a suction side of pump 80 established in piston side chamber 22 pump 80 can pump fluid from piston side chamber 22 and/or from reservoir 60 through opening 89 to a major volume of rod side chamber 26. With check valve 86 separating piston side chamber 22 and reservoir 60 open, fluid from piston side chamber 22 that is drawn by pump 80 can be output through check valve 86 into reservoir 60.

Figure 3:
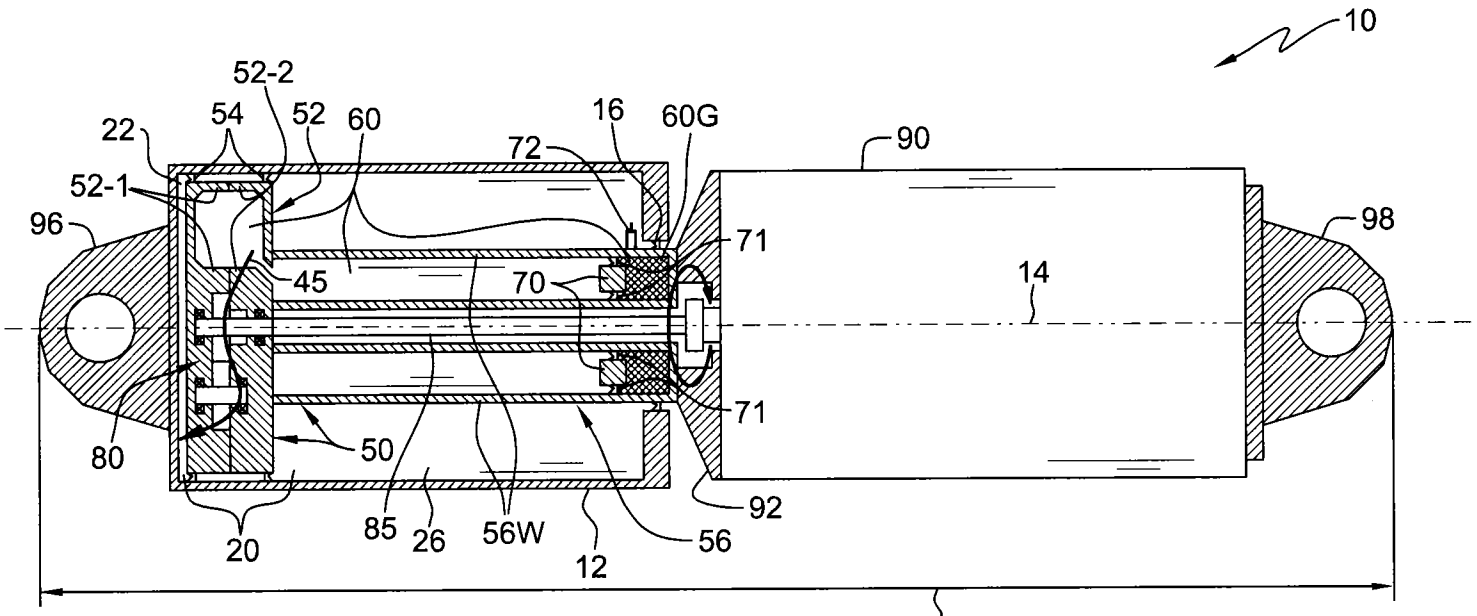
FIG. 3 is a cross sectional view of an actuator wherein a piston assembly is in a retracted position.
Figure 4:
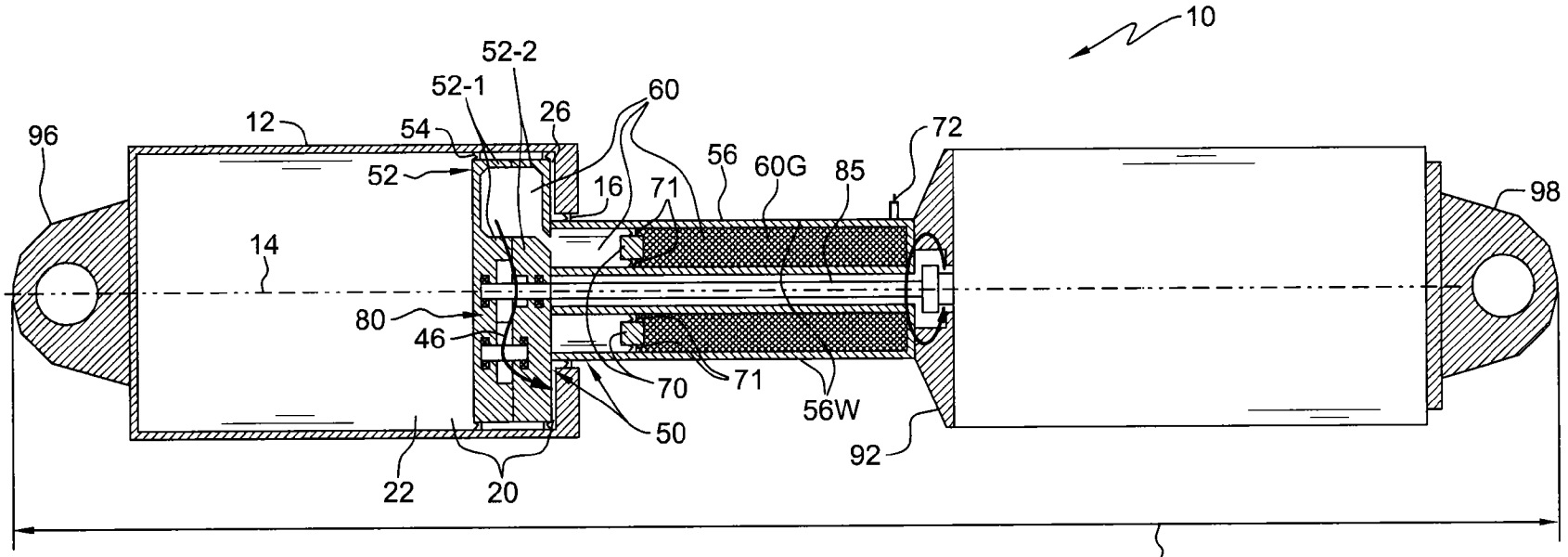
FIG. 4 is a cross sectional view of an actuator wherein a piston assembly is in an extended position.

In a further aspect of actuator 10, an interior surface of a wall as shown in FIGS. 1, 3 and 4 defining housing 12 can be cylindrical. Piston 52 and rod 56 can include respective walls 52-1, 52-1 (piston) and 56W (rod) having outer surfaces defining respective outer surfaces of piston 52 and rod 56. Outer surfaces of piston 52 and rod 56 can be cylindrical. For maintaining fluid separation between piston side chamber 22 and rod side chamber 26, piston 52 which can move within an interior of housing 12 along longitudinal axis 14 of housing 12, can include seal 54 which engages the interior surface of a wall defining housing 12. An inner surface of a wall defining housing 12 can be cylindrical. Seal 54 can be fixedly attached to an exterior surface of wall defining piston 52 as illustrated in FIGS. 1, 3 and 4. Seal 54 can circumferentially extend around walls 52-1 and 52-2 defining piston 52. For preventing fluid escape through an interface between housing 12 and piston assembly 50, housing 12 can include a seal 16 adapted for engagement with rod 56 which moves into and out of an interior of housing 12. Seal 16 can be fixedly attached to housing 12 at a perimeter defining an opening into an interior of housing 12 as is seen in FIGS. 1, 3 and 4.

Operation of actuator 10 to provide actuation is now described. In general, actuation can be provided by the movement of piston assembly 50 into and out of an interior of housing 12. Actuator 10 can include mounts 96 and 98 supported in fixed positions in relation to housing 12 and piston rod 56 respectively so that operation of actuator 10 moves a pair of arbitrary mechanical members connected to mount 96 and to mount 98 respectively. Actuator 10 can provide actuation by the action of piston rod 56 being moved between a first position and a second position or between a second position and a first position. The first position can be a more extended position and the second position can be a less extended position. The first position can alternatively be regarded as a less retracted position. The second position can alternatively be regarded as a more retracted position. Referring to FIG. 1, mount 98 can be supported in a fixed position in relation to housing 12 by being joined directly to housing 12 as shown in FIG. 1 or else can be supported in a fixed position in relation to housing 12 by being rigidly joined to housing 12 through one or more additional members. Mount 98 can be supported in a fixed position in relation to piston rod 56 by being rigidly joined directly to piston rod 56 or rigidly joined to piston rod 56 through one or more additional members, e.g. support 92 and motor 90 as depicted in FIG. 1.

Referring to FIG. 3, FIG. 3 illustrates an actuator 10 with piston assembly 50 in a maximally retracted position. In a maximally retracted position, piston assembly 50 is maximally retracted within chamber region 20 so that piston side chamber 22 is at a minimal volume and further so that rod side chamber 26 is at a maximal volume. A length, L, of actuator 10 is at a minimum when piston assembly 50 is at a maximally retracted position as is set forth in FIG. 3.

Operation of actuator 10 when actuator 10 moved from a maximally retracted position toward a maximally extended position is now described in reference to FIGS. 2 and 3. For moving piston assembly 50 from a maximally retracted position toward a maximally extended position, pump 80 can be operated in a first direction. Actuator 10 can be configured so that when pump is operated in a first direction, piston side chamber 22 can enter a pressure state, rod side chamber 26 can enter a suction state, check valve 86 separating piston side chamber 22 from reservoir 60 can close and check valve 88 separating rod side chamber from reservoir 60 can open. With piston side chamber 22 in a pressure state and rod side chamber 26 in a suction state pump 80 can move fluid from rod side chamber 26 and/or from reservoir 60 to piston side chamber 22. Actuator 10 can be configured so that when fluid indicated by arrow 45 moves from rod side chamber 26 and/or from reservoir 60 into piston side chamber 22, fluid can move from rod side chamber 26 to reservoir 60 through check valve 88 by the action of the suction side of pump 80 drawing fluid from rod side chamber 26 into reservoir 60 through check valve 88 separating rod side chamber 26 and reservoir 60. When fluid moves from rod side chamber 26 and from reservoir 60 into piston side chamber 22 and from rod side chamber 26 into reservoir 60, piston assembly 50 is urged rightward in the view of FIG. 3 and accordingly piston rod 56 extends further outwardly from an interior of housing 12 to provide actuation, e.g. relative movement between any two arbitrary members mounted to mount 96 and mount 98 respectively.

Referring to FIG. 4, FIG. 4 illustrates an actuator 10 with piston assembly 50 in a maximally extended position. In a maximally extended position of piston assembly 50, piston side chamber 22 is at a maximum volume and rod side chamber 26 is at a minimum volume as is illustrated in FIG. 4.

A length, L, of actuator 10 is at a maximum when piston assembly 50 is at a maximally extended position as is set forth in FIG. 4. Operation of actuator 10 when actuator 10 retracts from maximally extended position is now described in reference to FIG. 2 and FIG. 4. For moving piston assembly 50 from a maximally extended position toward a maximally retracted position, pump 80 can be operated in a second direction opposite the first direction. Actuator 10 can be configured so that when pump 80 is operated in a second direction opposite a first direction, rod side chamber 26 can enter a pressure state, piston side chamber 22 can enter a suction state, check valve 86 separating piston side chamber 22 from reservoir 60 can open and check valve 88 separating rod side chamber from reservoir 60 can close. With rod side chamber 26 in a pressure state and piston side chamber 22 in a suction state, pump 80 can move fluid from piston side chamber 22 and/or from reservoir 60 to rod side chamber 26. Actuator 10 can be configured so that when fluid indicated by arrow 46 moves from piston side chamber 22 and/or from reservoir 60 into rod side chamber 26, fluid can move from piston side chamber 22 to reservoir 60 through check valve 86 by the action of the suction side of pump 80 drawing fluid from piston side chamber 22 into reservoir 60 through check valve 86 separating piston side chamber 22 and reservoir 60. When fluid moves from piston side chamber 22 and from reservoir 60 into rod side chamber 26 and from piston side chamber 22 into reservoir 60, piston assembly 50 is urged leftward in the view of FIG. 4 and accordingly piston rod 56 can be retracted further inwardly into an interior of housing 12 to provide actuation, e.g. relative movement between any two arbitrary members mounted to mount 96 and mount 98 respectively.

Comparing FIGS. 3 and 4 it can be seen that, because of a volume consumed by piston rod 56, a maximum volume of piston side chamber 22 (occurring when piston assembly 50 is in a maximum extended position as shown in FIG. 4) is greater than a maximum volume of rod side chamber 26 (occurring when piston 52 is in a maximally retracted position as shown in FIG. 3). With piston assembly 50 in a maximally extended position (FIG. 4), the volume, $V_C$, of chamber region 20 is given by:

$$V_C = V_i - V_P \quad \text{(Eq. 1)}$$

where $V_i$ is the volume of the interior of housing 12, and where $V_P$ is the volume of piston 52.

With piston assembly 50 in a maximally retracted position (FIG. 3), the volume, $V_C$, of chamber region 20 is given by:

$$V_C = V_i - (V_P + V_R) \quad \text{(Eq. 2)}$$

where $V_i$ is the volume of the interior of housing 12, where $V_P$ is the volume of piston 52 and where $Y_R$ is the volume of rod 56.

To compensate for the changing volume of different chambers of chamber region 20, reservoir 60 of piston assembly 50 can be configured to include a gas chamber area 60G for containing a compressible gas that is capable of volume change. A volume of compressible gas within gas chamber area 60G can expand or retract. To allow expansion and retraction of compressible gas within gas chamber area 60G, reservoir 60 can include separating member 70 as shown in the views of FIGS. 1 and 3-4 that can separate a gas chamber area 60G of reservoir 60 from a remainder of reservoir 60. A remainder of reservoir 60 external to gas chamber area 60G can be filled with fluid, e.g. oil, and can be regarded as a fluid chamber area of reservoir 60.

With piston assembly 50 in a maximally retracted position as shown in FIG. 3, a maximum amount of fluid can be stored in reservoir 60 and gas of gas chamber area 60G can be highly compressed. With piston assembly 50 in a maximally extended position as shown in FIG. 4, a minimum amount of fluid can be stored in reservoir 60 and gas of gas chamber area 60G can become expanded and can be less compressed. In a further aspect, actuator 10 can include a port 72, as shown in the views of FIGS. 1, 3 and 4, for allowing adjustment of pressure of reservoir 60. In one embodiment, port 72 can be provided by an opening which causes reservoir pressure to adjust to equal atmospheric pressure. In addition to providing compensation for changing volumes of fluid within chamber region, gas chamber area 60G containing compressible gas provides for compensation of changing volumes of fluid within chamber region 20 resulting from temperature changes.

In the embodiment shown in FIGS. 1 and 3-4, separating member 70 can be substantially rigid and can be made to slide back and forth on an annulus facing surface of a wall of piston assembly 50, e.g. of wall 56I and/or wall 56W. Separating member 70 can have fixedly attached thereto seal 71 which can be adapted to slide along an annulus facing surface of a wall defining piston assembly 50 as shown in the views of FIGS. 1, 3 and 4 while preventing fluid transfer from a fluid chamber area of reservoir 60 to a gas chamber area 60G of reservoir 60. Seal 71 can be fixedly attached to inner and outer perimeters of separating member 70 shown as an annular separating member in FIGS. 1, 3 and 4.

Figure 5:
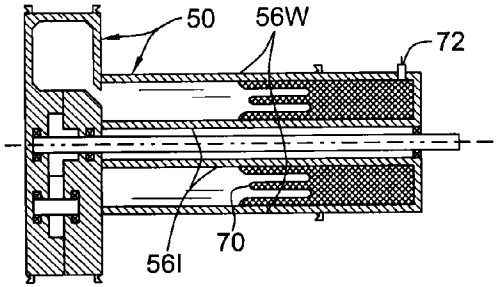
FIG. 5 is a cross sectional view of a piston assembly in an alternative embodiment illustrating an alternative separating member for defining a gas chamber.

Separating member 70 can alternatively be provided by a flexible member e.g. a bladder or a diaphragm. FIG. 5 illustrates an embodiment of a piston assembly having a separating member 70 provided by a flexible bladder. Where separating member 70 is provided by a flexible member, separating member 70 can be attached at a fixed position within reservoir 60 and can expand or contract as the volume requirements of gas chamber area 60G of reservoir 60 change. In one embodiment, separating member 70 can be flexible member that is attached as shown in FIG. 5 at a fixed position on annulus facing surfaces of walls 56I and 56W of piston assembly 50.

Figure 6:
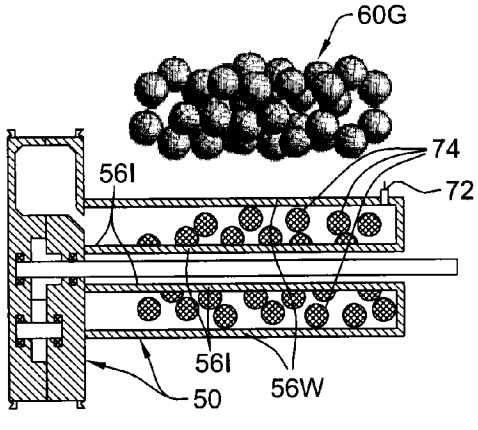
FIG. 6 is a cross sectional view of a piston assembly in a first alternative embodiment illustrating an alternative configuration for a gas chamber area for accommodating changes in fluid volume within a chamber region.
Figure 7:
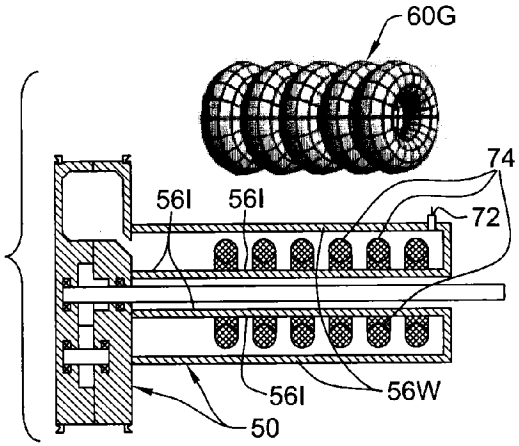
FIG. 7 is a cross sectional view of a piston assembly in a second alternative embodiment illustrating an alternative configuration for a gas chamber area for accommodating changes in fluid volume within a chamber region.

Referring to the embodiments illustrated in FIGS. 6 and 7, piston assembly 50 can include alternative configurations for gas chamber area 60G that adapt piston assembly 50 to compensate for volumetric changes in fluid within chamber region 20. In the embodiment of FIGS. 6 and 7, a gas chamber area 60G of reservoir 60 can be defined by one or more gas filled and compressible pocket 74. In the embodiments of FIGS. 6 and 7, reservoir 60 includes a plurality of gas filled and compressible pockets 74. Pockets 74 can be free floating or fixedly attached to a member. Pockets 74 can be of any volumetric shape. In the embodiment, of FIG. 6, pockets 74 can be spherical and free floating within reservoir 60. In the embodiment of FIG. 7, pockets 74 are torus shaped and fixedly attached to an annulus facing surface of a wall, e.g., wall 56I of piston assembly 50, defining reservoir 60.

Figure 8:
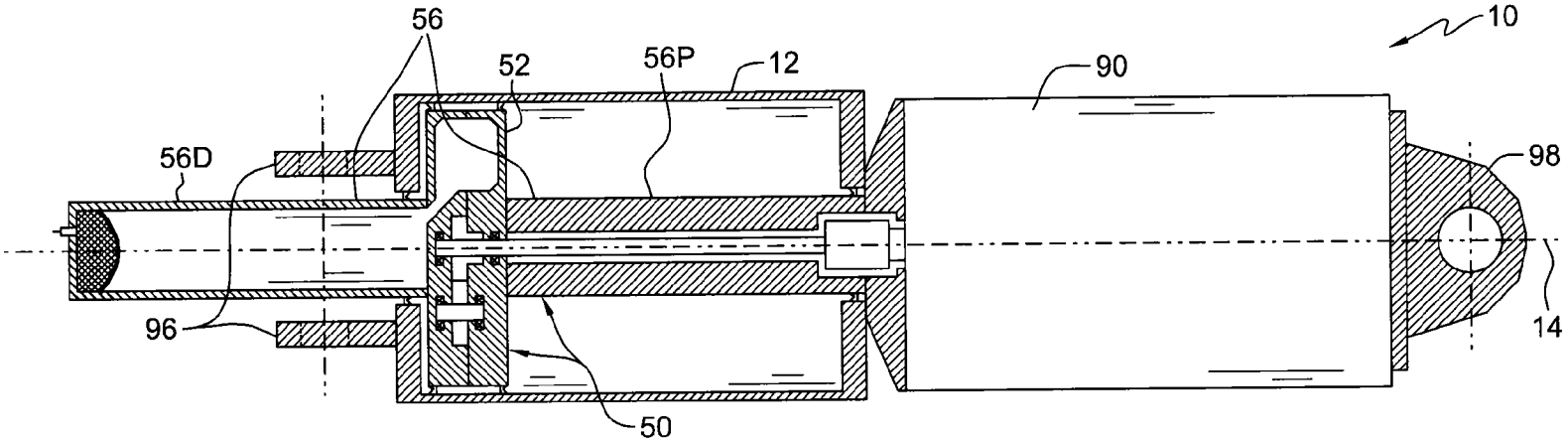
FIGS. 8 and 9 are cross sectional views of an actuator in an alternative embodiment wherein a piston assembly is configured so that a volume of fluid within a chamber region of the actuator can remain constant irrespective an extent of an extension of the piston assembly from an actuator housing.
Figure 9:
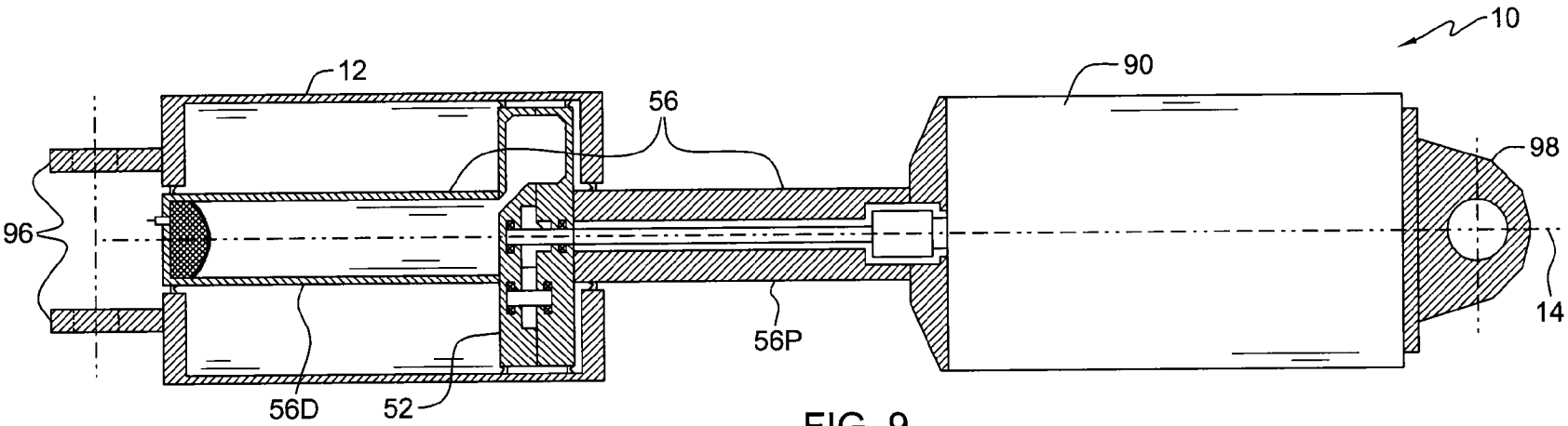

In one embodiment actuator 10 can be configured so that a volume of chamber region 20 does not change when piston assembly 50 is extended from or retracted into housing 12. In the embodiment of FIGS. 8 and 9, piston rod 56 does not terminate at piston 52 as in the embodiments of FIGS. 1 and 2-7 but instead has a first proximal section 56P extending proximally from piston 52 toward motor 90 and a second distal section 56D extending distally from piston 52 away from motor 90. Each of first proximal section 56P and second distal section 56D can consume equal volumes so that a volume of chamber region 20 within housing 12 remains constant as piston assembly 50 extends from or is retracted into housing 12. Because a volume of chamber region 20 can remain constant in the embodiment of FIGS. 8 and 9 when piston assembly 50 is extended from or retracted into housing 12, actuator 10 in the embodiment of FIGS. 8 and 9 can be absent of gas chamber area 60G. In one variation, the embodiment of FIGS. 8 and 9 includes a gas chamber area 60G according to one or more of the configurations set forth herein for purposes of compensating for fluid volume variations resulting from temperature changes. The embodiment of FIGS. 8 and 9 can otherwise be featured as set forth in response to FIGS. 1-4.

Figure 10:
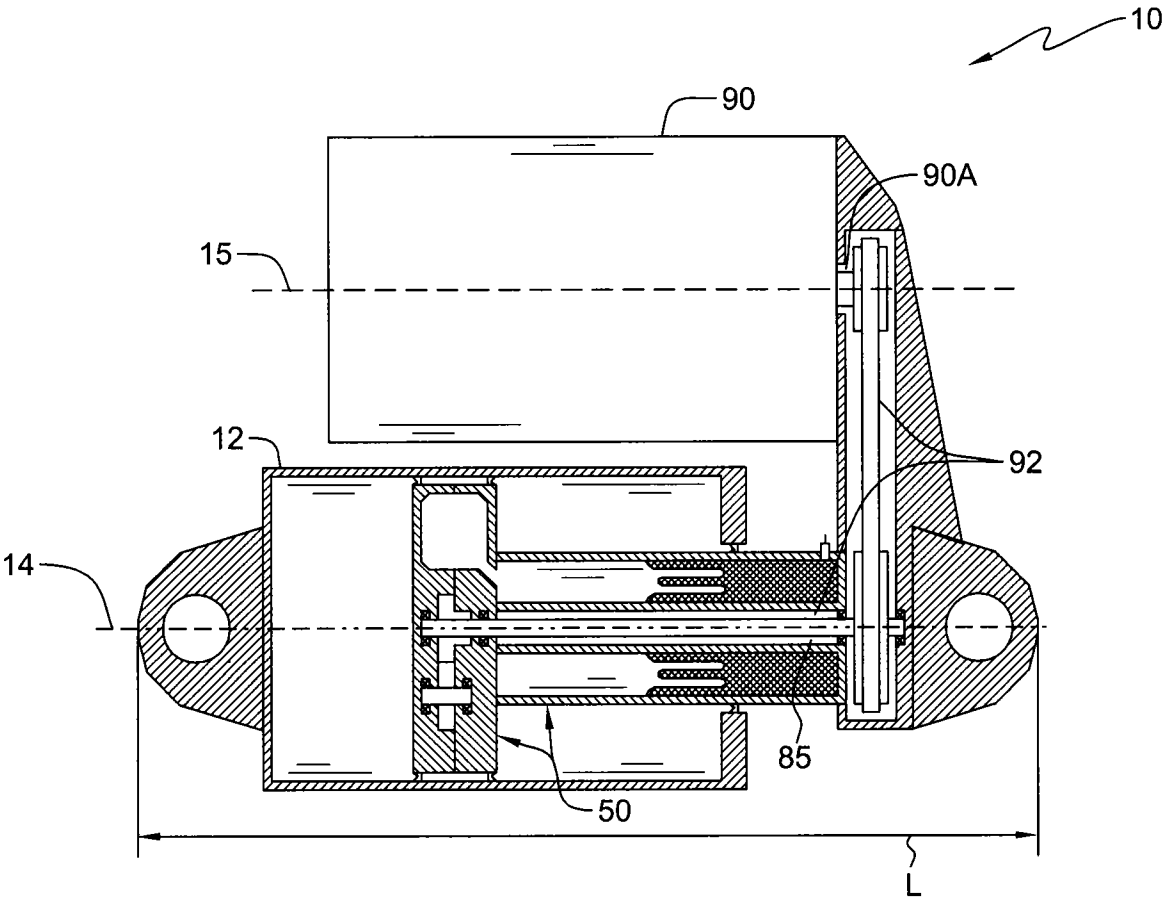
FIG. 10 is a cross sectional view of an actuator in an alternative embodiment wherein a motor is disposed adjacent to and parallel to an actuator housing that receive a piston assembly.

In one embodiment, a length, L, of actuator 10 can be reduced to allow actuator 10 to be deployed in reduced dimension work area environments without reduction of a force imparting capacity of actuator 10. In the embodiment of FIG. 10, motor 90 of actuator is arranged adjacent to parallel to housing 12 rather than in series with housing 12 to reduce a minimal and maximal length, L, of actuator 10. In the embodiment of FIG. 10, pump 80 can be mechanically coupled to motor 90 with use of chain 93 or an alternative mechanical link. In the embodiment of FIG. 10, actuator 10 can be configured so that a length of actuator 10 is not defined by a length of motor 90. In the embodiments of FIGS. 1-9 a longitudinal axis 15 of motor 90 can be co-located with a longitudinal axis 14 of housing 12. In the embodiment of FIG. 10, longitudinal axis 15 of motor 90 can be spaced apart from, adjacent to and parallel to a longitudinal axis 14 of housing 12.

Figure 11:
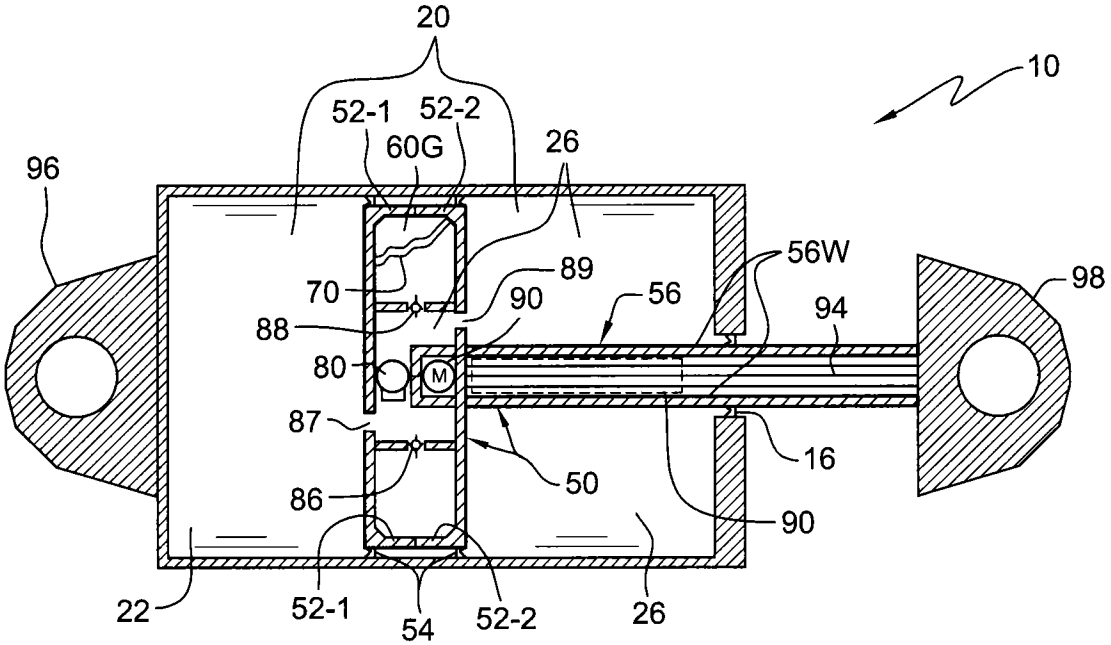
FIG. 11 is a cross sectional view of an actuator in an alternative embodiment, wherein a reservoir and a motor are disposed entirely in an interior of a piston assembly.

Referring to FIG. 11, another embodiment of actuator 10 is described. In the embodiment of FIG. 11, reservoir 60 and pump 80 functioning as in the embodiment of FIGS. 1-4, are included in an interior of piston assembly 50. Actuator 10 in the embodiment of FIG. 11 can further include openings 87 and 89 functioning in the manner of openings 87 and 89 set forth in reference to the embodiments of FIGS. 1-4, as well as check valves 86 and 88 and seals 54 and 16 functioning in the manner of check valves 86 and 88 and seals 54 and 16 as set forth in the embodiment of FIGS. 1-4. In the embodiment of FIG. 11, reservoir 60 can be disposed in an interior of piston assembly 50 by way of being entirely disposed in an interior of piston 52. In the embodiment of FIG. 11, motor 90 can be disposed in an interior of piston assembly 50 by way of being entirely disposed in an interior of piston 52. Motor 90 can be battery operated or can be coupled to a power supply (not shown) by cable 94 extending through an interior of piston rod 56. In a variation of the embodiment of FIG. 11, motor 90 can be positioned within an interior of piston rod 56, e.g., entirely within an interior of piston rod 56 at the location of motor 90 that is shown in dashed form in FIG. 11. A commercially available motor can have a form factor of an elongated cylindrical volumetric shape which can correspond to a shape of an interior of piston rod 56 shown in FIG. 11 as being defined by wall 56W. Motor 90 can be mechanically coupled to pump 80, e.g., via a motor axle 90A coupled to a pump shaft 85 (as shown in, e.g., FIG. 1), so that motor 90 can drive pump 80. Pump 80 can be provided by a gear pump as set forth in reference to the embodiment of FIGS. 1-4, but alternatively can be provided by another type of rotary pump, e.g., a shuttle block pump, a screw pump, a flexible vane pump, a flexible impeller pump. Pump 80 can alternatively be provided by other than a rotary pump. For example, pump 80 can be provided by a reciprocating pump, or a linear type positive displacement pump. Pump 80 can alternatively be provided by other than a positive displacement pump, e.g. can be provided by an impulse pump, a velocity pump, or a gravity pump. Separating member 70 in the embodiment of FIG. 11 can function in the member of the flexible separately member 70 as set forth in FIG. 5 or actuator 10 can have one or more other configurations for gas chamber area 60G as set forth herein. Actuator 10 as set forth in FIG. 11 can otherwise function in the manner set forth in reference to FIGS. 1-4.

A major advantage of actuators set forth herein is that with reservoir 60 included within an interior of piston assembly 50, an otherwise unused volume is utilized to yield miniaturization and reduced weight of actuator 10. Actuator 10 can therefore be used in applications with smaller space and weight requirements. An interior of piston assembly 50 can also include pump 80 and/or motor 90 to yield further miniaturization of actuator 10.

Further advantages of embodiments set forth herein include cost reductions in manufacturing and assembly because a volume of required material for construction of actuator 10 is reduced and because the number of precision machined parts required for manufacture of actuator 10 is reduced. In the embodiment of FIG. 11, precision machined parts can be limited to piston 52 as well as piston rod 56, which include surfaces that interact with seals of the actuator 10.

Figure 12:
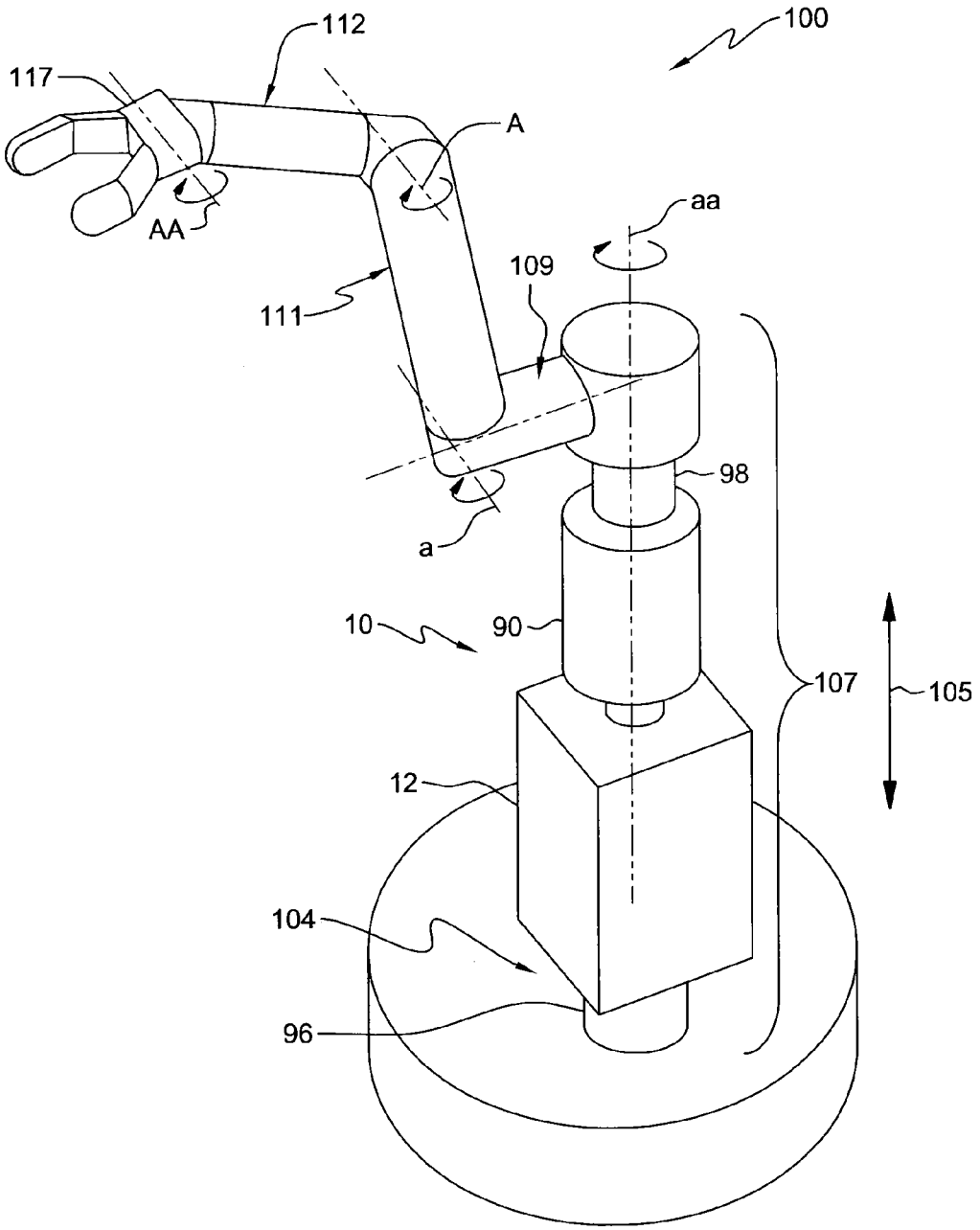
FIG. 12 is a perspective view of an articulated arm having an actuator as set forth herein.

An exemplary use of actuator 10 is set forth in reference in FIG. 12. An articulated arm 100 such an articulated arm of a robot can include actuator 10. An articulated arm 100 of a robot can have one or more link that can include (e.g. can incorporate or be provided by) actuator 10. An expanded view of an articulated arm 100 where articulated arm 100 is a robot arm in one exemplary implementation is shown in FIG. 12. Articulated arm 100 can include a support (base) link 107 which can be installed so that a proximal end 104 of link 107 is in a fixed position. Link 107 can include actuator 10 so that link 107 is capable of adjusting a height of the link 107, the height adjustment functioning represented by arrow 105. Link 109 can extend between rotary axis aa defined at a distal end of link 107 and rotary axis a defined at a distal end of link 109. Link 111 can extend between axis a and rotary axis A defined at a distal end of link 109. Link 112 can extend between rotary axis A and rotary axis AA defined at a distal end of link 112. Effector part 117 can be rotatably connected to link 112 so that effector part 117 can rotate in relation to link 112 about axis AA. A link other than or in addition to the link 107 can include actuator 10. For example one or more of link 109, link 111, or link 112 can include by actuator 10. Articulated arm 100 can include less than or greater than the degrees of freedom as shown in the implementation view of FIG. 12. Articulated arm 100 can include a joint facilitating rotation of link 109 about axis aa, a joint facilitating rotation of a link 111 about axis a, a joint facilitating rotation of a link about axis A, and a joint facilitating rotation of effector part 117 about axis AA. Effector part 117 can be, e.g., a gripper, or an alternative tool. Actuator 10 can be used for providing actuating in any environment requiring actuation.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprise" (and any form of comprise, such as "comprises" and "comprising"), "have" (and any form of have, such as "has" and "having"), "include" (and any form of include, such as "includes" and "including"), and "contain" (and any form contain, such as "contains" and "containing") are open-ended linking verbs. As a result, a method or device that "comprises," "has," "includes," or "contains" one or more steps or elements possesses those one or more steps or elements, but is not limited to possessing only those one or more steps or elements. Likewise, a step of a method or an element of a device that "comprises," "has," "includes," or "contains" one or more features possesses those one or more features, but is not limited to possessing only those one or more features. Likewise, the term "defined by" encompasses arrangements wherein a second element is fully defined by or partially defined by the first element. Similarly, the term "disposed in" encompasses arrangements herein a second element is entirely disposed in or partially disposed in a first element. Similarly, the term "based on" can encompass both "partially based on" causal relationships and "entirely based on" causal relationships. Also, the term "supported by" encompasses both "partially supported by" and "entirely supported by". Furthermore, a device or structure that is configured in a certain way is configured in at least that way, but may also be configured in ways that are not listed. While embodiments are set forth herein having a certain number of elements such embodiments can be practiced with less than or greater than the certain number of elements. Relationships set forth herein wherein a first element is described as supporting a second element can encompass relationships wherein the first element fully supports the second element and can encompass relationships wherein the first element partially supports the second element. Relationships set forth herein wherein a first element is described as described as defining a second element can encompass relationships wherein the first element fully defines the second element and can encompass relationships wherein the first element partially defines the second element.

The corresponding structures, materials, acts, and equivalents of all means or step plus function elements in the claims below, if any, are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of one or more aspects of the invention and the practical application, and to enable others of ordinary skill in the art to understand one or more aspects of the invention for various embodiments with various modifications as are suited to the particular use contemplated.

What is claimed is:

1. An apparatus comprising:

a piston assembly having a piston and a piston rod extending from the piston, the piston assembly defining a piston assembly interior;

a reservoir located within the piston assembly interior;

a housing, wherein the piston assembly is located within the housing to define a chamber region including a piston side chamber and a rod side chamber, the piston assembly moveable within the housing so that respective volumes of each of the piston side chamber and the rod side chamber are variable; and a pump for moving fluid between the reservoir and the chamber region.

2. The apparatus of claim 1, wherein the pump is located within the piston assembly interior.

3. The apparatus of claim 1, wherein the piston includes a piston interior and wherein the pump is located within the piston interior.

4. The apparatus of claim 1, wherein the apparatus comprises a motor located within the piston assembly interior.

5. The apparatus of claim 1, wherein for moving the piston assembly from a retracted position to an extended position, the pump pumps fluid from the rod side chamber and/or from the reservoir into the piston side chamber and draws fluid from the rod side chamber into the reservoir.

6. The apparatus of claim 1, wherein for moving the piston assembly from an extended position to retracted position, the pump pumps fluid from the piston side chamber and/or from reservoir into the rod side chamber and draws fluid from the rod side chamber into the reservoir.

7. The apparatus of claim 1, wherein disposed within the reservoir is a separating member that separates the reservoir into a gas chamber area and a fluid chamber area.

8. The apparatus of claim 7, wherein the separating member is fixedly attached to a wall of the piston assembly defining the reservoir.

9. The apparatus of claim 7, wherein the separating member is movably disposed within the reservoir.

10. The apparatus of claim 1, wherein the reservoir includes a gas chamber area defined by a compressible gas filled pocket, the compressible gas filled pocket being one of floating within the reservoir or secured to a surface of a wall defining the reservoir.

11. The apparatus of claim 1, wherein the piston of the piston assembly is entirely disposed within the housing and wherein the rod of the piston assembly is partially disposed to a variable distance within the housing.

12. The apparatus of claim 1, wherein an interior surface of a wall defining the housing and wherein an outer surface of a wall defining the piston are cylindrical.

13. The apparatus of claim 1, comprising a motor for driving the pump, the motor being arranged in relation to the housing so that the motor defines a length of an actuator having the piston assembly, reservoir, housing, and pump.

14. The apparatus of claim 1, comprising a motor for driving the pump, the motor being arranged in relation to the housing so that the motor does not define a length of an actuator having the piston assembly, reservoir, housing, and pump.

15. The apparatus of claim 1, wherein the apparatus is an articulated robot arm having a plurality of links, wherein a link of the plurality of links includes an actuator having the piston assembly, reservoir, housing, and pump.

* * * * *